US006870317B2

(12) United States Patent
Ito et al.

(10) Patent No.: US 6,870,317 B2
(45) Date of Patent: Mar. 22, 2005

(54) GAS DISCHARGE TUBE

(75) Inventors: Yoshinobu Ito, Hamamatsu (JP); Koji Kawai, Hamamatsu (JP); Tsuyoshi Minamizawa, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/416,698

(22) PCT Filed: Nov. 15, 2001

(86) PCT No.: PCT/JP01/09990

§ 371 (c)(1),
(2), (4) Date: May 13, 2003

(87) PCT Pub. No.: WO02/41358

PCT Pub. Date: May 23, 2002

(65) Prior Publication Data

US 2004/0021419 A1 Feb. 5, 2004

(30) Foreign Application Priority Data

Nov. 15, 2000 (JP) ..... P2000-348406

(51) Int. Cl.[7] ..... H01J 17/02; H01J 17/04

(52) U.S. Cl. ..... 313/631; 313/292; 313/581; 313/609; 313/610; 313/243

(58) Field of Search ..... 313/609, 610, 313/638, 637, 611, 612, 581, 639, 641, 292, 243, 622, 590

(56) References Cited

U.S. PATENT DOCUMENTS 4,698,546 A * 10/1987 Maitland et al. ..... 313/446
5,128,596 A * 7/1992 Shimazu et al. ..... 315/335
5,619,101 A * 4/1997 Ikedo et al. ..... 313/581
5,698,945 A * 12/1997 Ikedo et al. ..... 313/613
5,886,470 A 3/1999 Smolka ..... 313/637

FOREIGN PATENT DOCUMENTS

| | | |
|---|---|---|
| GB | 1214179 | 12/1970 |
| JP | 54-141780 | 10/1979 |
| JP | 06-310101 | 11/1994 |
| JP | 07-326324 | 12/1995 |
| JP | 08-077965 | 3/1996 |
| JP | 08-077969 | 3/1996 |
| JP | 08-077979 | 3/1996 |
| JP | 08-222185 | 8/1996 |
| JP | 08-222186 | 8/1996 |
| JP | 08-236081 | 9/1996 |

* cited by examiner

*Primary Examiner*—Vip Patel
*Assistant Examiner*—Anthony Perry
(74) *Attorney, Agent, or Firm*—Morgan, Lewis & Bockius LLP

(57) ABSTRACT

In a gas discharge tube 1 of the present invention, a focusing electrode portion 14 and a discharge limiting portion 30 are electrically insulated, and the discharge limiting portion 30 comprises a discharge limiting opening 31 which opposes an arc ball shaping concave portion 16. Thus the formation of a discharge path from a cathode portion 20 to the concave portion 16 is ensured and a starting discharge can be reliably generated. Further, by means of the discharge limiting opening 31 which opposes the concave portion 16, an arc ball S can be continuously maintained in an appropriate shape even when a lamp is illuminated, and thus the arc ball S can be shaped with stability, thereby stabilizing the luminance and light quantity.

5 Claims, 9 Drawing Sheets

GAS DISCHARGE TUBE

TECHNICAL FIELD

The present invention relates particularly to a gas discharge tube for use as a light source in a spectroscope, in chromatography, and so on.

BACKGROUND ART

Japanese Patent Application Laid-open Publication H6-310101 discloses conventional technology in this field. In a gas (deuterium) discharge tube described in this publication, two metallic partition walls are disposed on a discharge path between an anode and a cathode, a small hole is formed in each partition wall, and the discharge path is narrowed by these small holes. As a result, light of a high luminance can be obtained by means of the small holes on the discharge path. If three or more metallic partition walls are provided, even higher luminance is obtained, and the luminance of the light increases as the small holes are made smaller.

DISCLOSURE OF THE INVENTION

However, the following problems exist in the conventional gas discharge tube described above. That is, no voltage is applied to the metallic partition walls, and the small holes in the metallic partition walls are used simply to narrow the discharge path. Accordingly, as is described in the publication itself, although luminance may indeed be increased by narrowing the discharge path, a problem arises in the fact that it becomes increasingly difficult to generate a starting discharge as the small holes are reduced in diameter. Note that Japanese Patent Application Laid-Open Publication H7-326324, Japanese Patent Application Laid-Open Publication H8-236081, Japanese Patent Application Laid-Open Publication H8-77965, Japanese Patent Application Laid-Open Publication H8-77969, Japanese Patent Application Laid-Open Publication H8-77979, Japanese Patent Application Laid-Open Publication H8-222185, Japanese Patent Application Laid-Open Publication H8-222186, and so on, submitted by the same company, also disclose gas discharge tubes.

The present invention has been designed in order to solve the aforementioned problems, and it is a particular object thereof to provide a gas discharge tube in which favorable statability is provided while realizing high luminance.

A gas discharge tube according to the present invention is caused to discharge a predetermined light toward the outside from a light exit window of a hermetically sealed container by sealing gas inside the hermetically sealed container and generating discharge between an anode portion and a cathode portion disposed within the hermetically sealed container, and is characterized in comprising: a focusing electrode portion which is connected to an external power source and comprises a focusing opening disposed between the anode portion and cathode portion for narrowing a discharge path and an arc ball shaping concave portion which widens toward the light exit window; and a ceramic discharge limiting portion disposed between the focusing electrode portion and cathode portion and comprising a discharge limiting opening formed opposite the concave portion.

When high luminance light is to be produced, it is not simply a case of reducing the diameter of the focusing opening of the focusing electrode portion since the more the diameter thereof is reduced, the more difficult it becomes to generate discharge when the lamp is activated. Moreover, in order to improve the statability of the lamp, an extremely large potential difference must be generated between the cathode portion and anode portion, as a result of which the longevity of the lamp is reduced, as has been confirmed experientially. Hence in the gas discharge tube of the present invention, the focusing electrode portion and discharge limiting portion are electrically insulated and the discharge limiting portion is provided with a discharge limiting opening which opposes the arc ball shaping concave portion. Thus the formation of a discharge path from the cathode portion to the concave portion is ensured and a starting discharge can be reliably generated. Further, by means of the discharge limiting opening 31 which opposes the concave portion, an arc ball can be continuously maintained in an appropriate shape even when a lamp is illuminated, and thus the arc ball can be shaped with stability, thereby stabilizing the luminance and light quantity.

It is preferable that the discharge limiting opening be disposed opposite the concave portion in order to narrow an opening part of the concave portion on the light exit window side. By employing such a constitution, the arc ball is formed in a favorable shape within the concave portion. It is further preferable that the discharge limiting opening be formed by a cylindrical protruding part which enters the concave portion from a main body part of the discharge limiting portion. By means of this protruding part discharge limiting opening, the arc ball generation region within the concave portion can be restricted, thereby raising the generation density of the arc ball in the discharge limiting opening such that luminance is increased.

It is also preferable that the discharge limiting opening be formed by a truncated cone-form protruding part which enters the concave portion from the main body part of the discharge limiting portion. By means of this protruding part discharge limiting opening, the arc ball generation region within the concave portion can be restricted, thereby raising the generation density of the arc ball in the discharge limiting opening such that luminance is increased.

Further, the discharge limiting portion is preferably formed from an electrically insulating ceramic. By forming the discharge limiting portion itself from a ceramic in this manner, electrical insulation between the focusing electrode portion and discharge limiting plate portion, which are disposed in proximity, can be easily realized.

BEST MODES FOR CARRYING OUT THE INVENTION

Various preferred embodiments of a gas discharge tube according to the present invention will be described in detail below on the basis of the drawings.

(First Embodiment)

Figure 1:
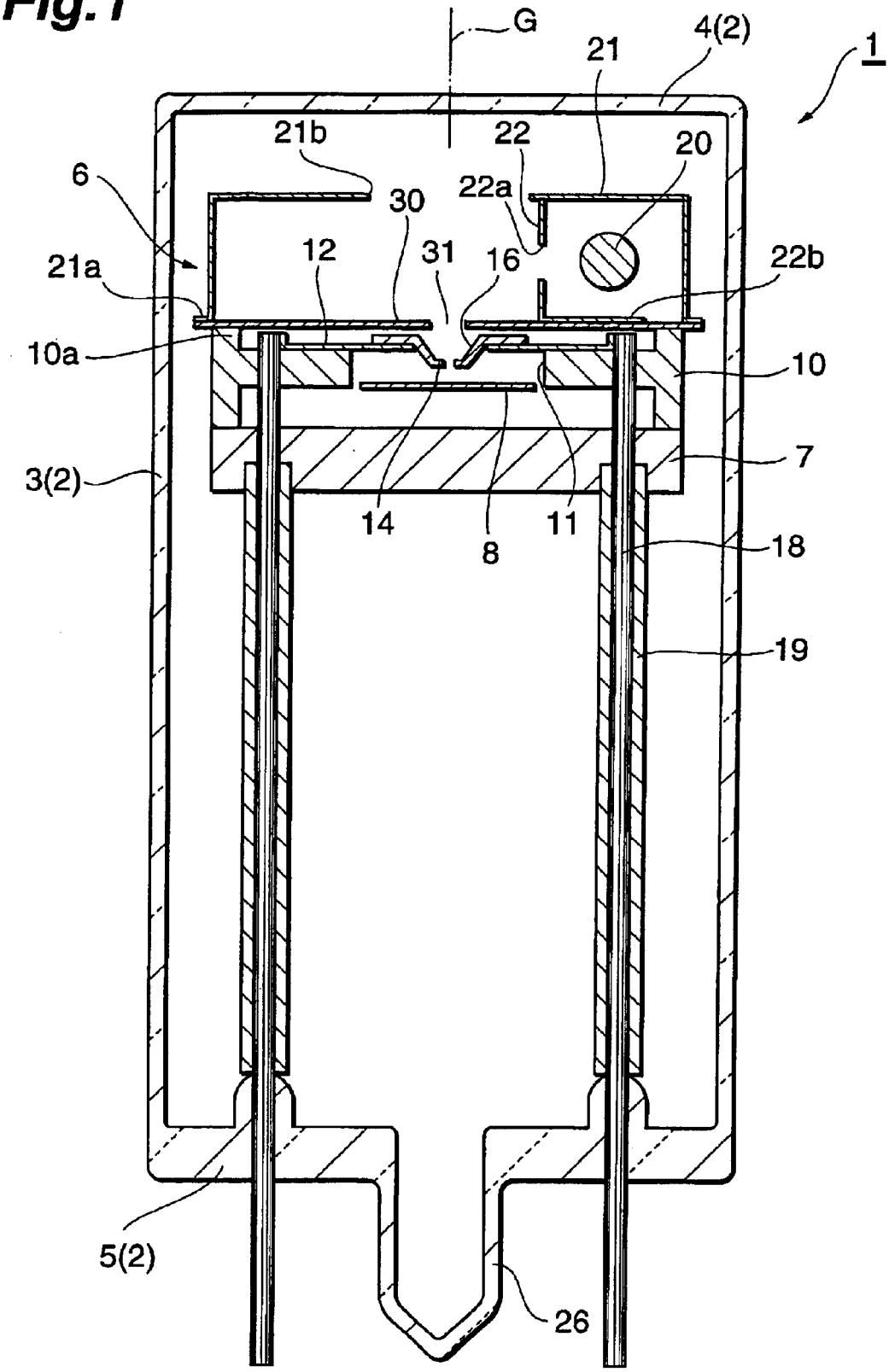
FIG. 1 is a sectional view showing a first embodiment of a gas discharge tube according to the present invention.
Figure 2:
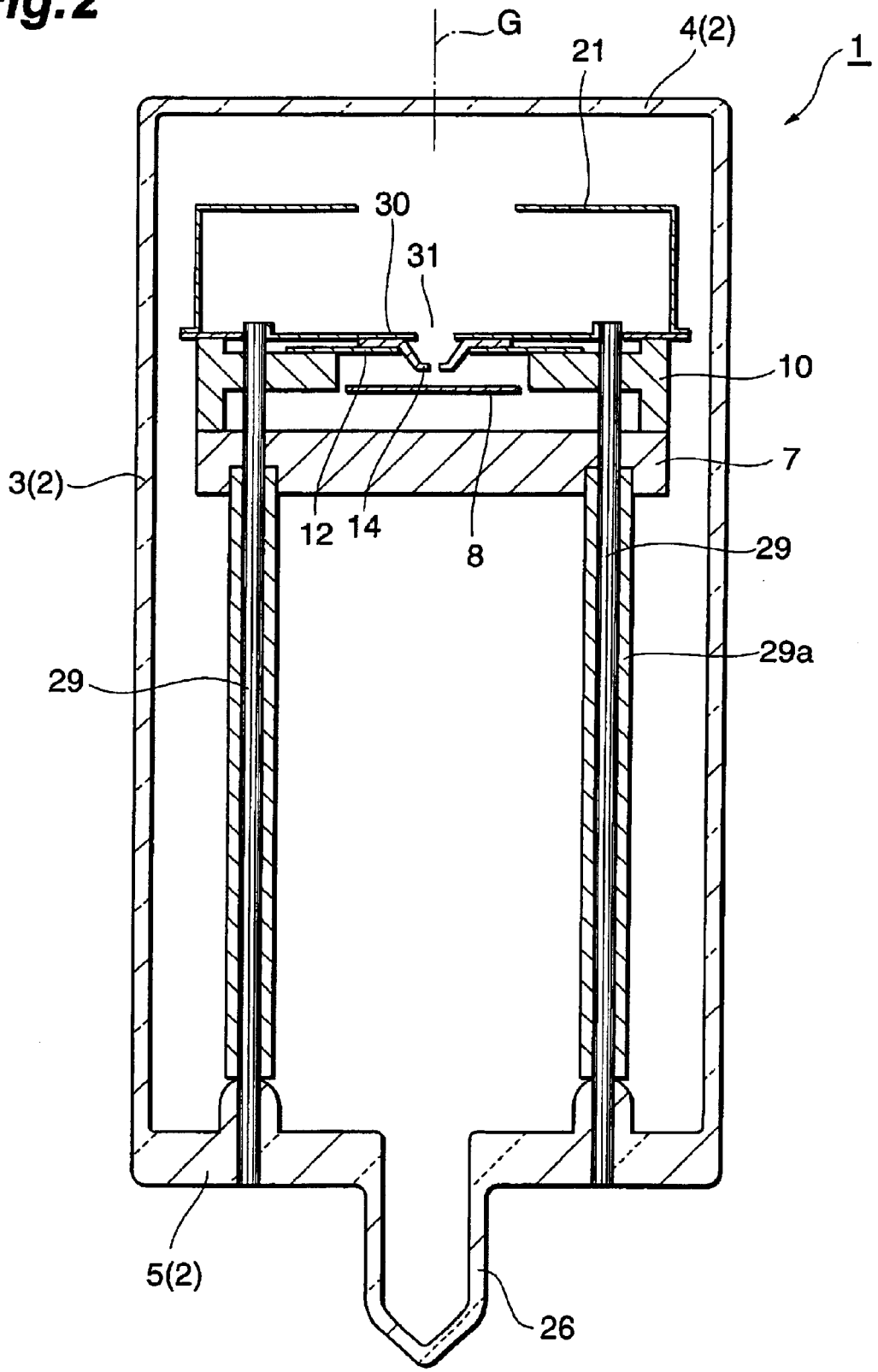
FIG. 2 is a sectional view of the gas discharge tube shown in FIG. 1.

As shown in FIGS. 1 and 2, a gas discharge tube 1 is a head-on type deuterium lamp. The gas discharge tube 1 comprises a glass hermetically sealed container 2 into which deuterium gas is sealed at approximately several hundred Pa. The hermetically sealed container 2 is constituted by a cylindrical side tube 3, a light exit window 4 which seals one side of the side tube 3, and a stem 5 which seals the other side of the side tube 3. A light-emitting portion assembly 6 is housed inside the hermetically sealed container 2.

The light-emitting portion assembly 6 is provided with a disk-form base portion 7 made of an electrically insulating ceramic, and an anode plate (anode portion) 8 is supported on this base portion 7. The anode plate 8 is separated from the base portion 7 and electrically connected to respective distal end parts of stem pins (not shown) which are disposed in a standing position in the stem 5 so as to extend in the direction of a tube axis G.

The light-emitting portion assembly 6 is provided with a disk-form focusing electrode support portion 10 made of an electrically insulating ceramic. This focusing electrode support portion 10 is placed on the base portion 7 so as to be superposed thereon and is formed with an identical diameter to the base portion 7. A circular opening 11 is formed in the center of the focusing electrode support portion 10, and this opening 11 is formed such that the anode plate 8 peeks out therefrom. A disk-form conductive plate 12 contacts the upper face of the focusing electrode support portion 10.

Further, a focusing electrode portion 14 made of metal (for example molybdenum, tungsten, or an alloy thereof) is fixed by welding to the center of the conductive plate 12 in order to narrow the discharge path, and an arc ball shaping concave portion 16 is formed in this focusing electrode portion 14. The concave portion 16 houses an arc ball produced by discharge and is formed in a cup form widening toward the light exit window 4 so that light can be efficiently extracted. A discharge path narrowing opening 17 constituted by a small hole with a 0.5 mm diameter and positioned on the tube axis G is formed in the bottom face of the concave portion 16 such that a compressed ball-shaped arc ball S is formed within the concave portion 16, thereby increasing luminance (see FIG. 3).

The conductive plate 12 is electrically connected to the distal ends of stempins 18 which are disposed in a standing position in the stem 5 so as to pass through the base portion 7 and focusing electrode support portion 10, thus enabling electric power to be supplied from outside to the focusing electrode portion 14. Note that the stem pins 18 are enveloped in ceramic electrically insulating tubes 19 so as not to be exposed between the stem 5 and support portion 7.

Further, a cathode portion 20 is disposed in the light-emitting portion assembly 6 in a position removed from the optical path on the light exit window 4 side, and the two ends of this cathode portion 20 are electrically connected to the respective distal end parts of two stem pins (not shown) disposed in a standing position in the stem 5 so as to pass through the base portion 7 and focusing electrode support portion 10. Thermoelectrons are generated by the cathode portion 20, or more specifically, the cathode portion 20 comprises a tungsten coil portion which extends parallel to the light exit window 4 and generates thermoelectrons.

The cathode portion 20 is housed inside a cap-form metallic front cover 21. A flange portion 21*a* of the front cover 21 is attached to a discharge limiting plate 30 to be described hereinafter, and fixed inside the hermetically sealed container 2. A circular light transmitting port 21*b* is formed in the front cover 21 at the part which opposes the light exit window 4.

A discharge current plate 22 is provided inside the front cover 21 in a position removed from the optical path between the cathode portion 20 and focusing electrode portion 14. An electron-emitting window 22*a* of the discharge current plate 22 is formed as a rectangular opening for transmitting thermoelectrons. The discharge current plate 22 is fixed by placing a leg piece 22*b* provided on the discharge current plate 22 on the upper face of the discharge limit plate 30 to be described hereinafter. Thus the cathode portion 20 is surrounded by the front cover 21 and the discharge current plate 22 such that sputtering material or evaporated material emitted from the cathode portion 20 does not adhere to the light exit window 4.

The light-emitting portion assembly 6 constituted in the above manner is provided inside the hermetically sealed container 2, and since the interior of the hermetically sealed container 2 must be filled with deuterium gas at several hundred Pa, a glass exhaust pipe 26 is formed integrally with the stem 5 of the hermetically sealed container 2 in the center thereof. This exhaust pipe 26 is sealed by being fused at the end of the assembly process after the air inside the hermetically sealed container 2 has been removed and deuterium gas of a predetermined pressure has been appropriately filled therein. Note that a noble gas such as helium or neon may be sealed into the gas discharge tube 1 in other examples thereof.

Figure 3:
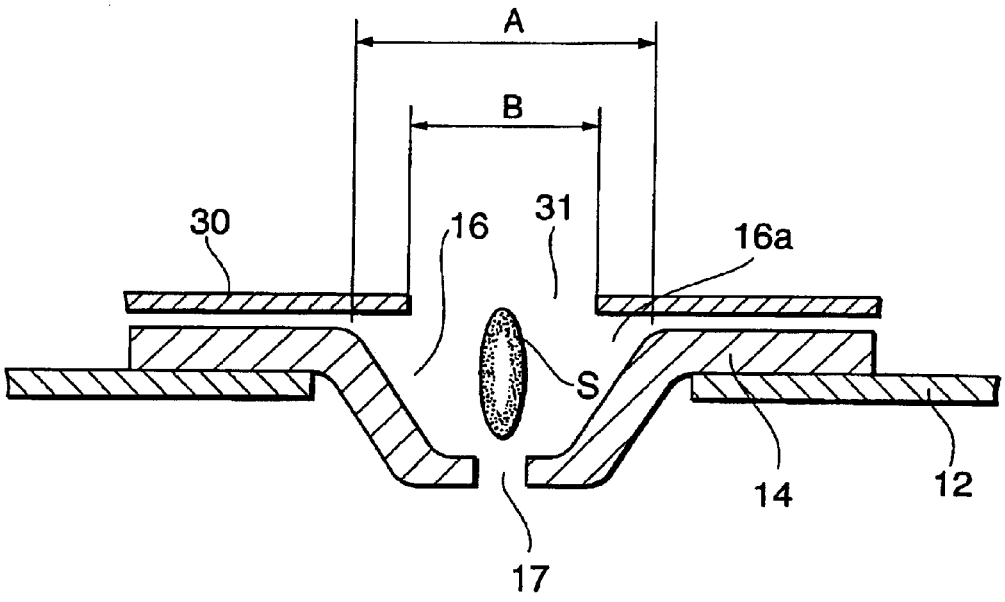
FIG. 3 is an enlarged sectional view of the main parts of the gas discharge tube shown in FIG. 1.

In this case, as shown in FIGS. 1 and 3, a ceramic discharge limiting portion (discharge limiting plate) 30 is disposed between the focusing electrode portion 14 and cathode portion 20. This discharge limiting plate 30 contacts the upper face of a protruding portion 10*a* of the focusing electrode support portion 10 to thereby be separated from the conductive plate 12 in the tube axis G direction, and is electrically connected to the focusing electrode portion 14 through a gap.

The discharge limiting plate 30 is fixed to the distal ends of stem pins 29 disposed in a standing position in the stem 5 so as to pass through the base portion 7 and focusing electrode support portion 10. The metal surface of the stem pins 29 which protrudes from the stem 5 may be removed. In this case, the protruding surface of the stempins 29 becomes non-conductive with an external power source. Note that the reference symbol 29*a* indicates a ceramic electrically insulating tube.

The discharge limiting plate 30 comprises a circular discharge limiting opening 31 formed opposite the concave portion 16. This discharge limiting opening 31 is formed in the tube axis G direction opposite an opening part 16*a* of the concave portion 16 on the light exit window 4 side so as to narrow the opening part 16*a*. If, for example, a diameter A of the opening part 16*a* of the concave portion 16 is 3.2 mm, a diameter B of the discharge limiting opening 31 is preferably 1.5 mm.

Hence the arc ball S shaping space on the cathode portion 20 side of the concave portion 16 is restricted by the discharge limiting opening 31 disposed in front of the concave portion 16, thus ensuring the formation of a discharge path from the cathode portion 20 to the concave portion 16 with the result that a starting discharge is reliably generated. The discharge limiting opening 31 also allows the arc ball S to be continuously maintained in a compressed ball shape even when the lamp is illuminated, and thus the arc ball S can be shaped with stability, thereby stabilizing the luminance and the light quantity.

Figure 4:
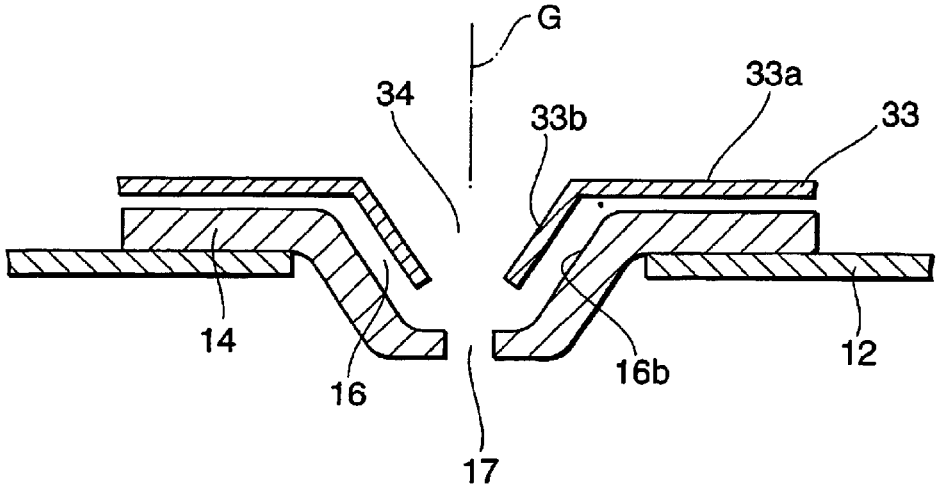
FIG. 4 is a sectional view showing a modified example of a discharge limiting portion which is applied to the gas discharge tube according to the present invention.

Note that another discharge limiting plate 33 extends parallel to the conductive plate 12, as shown in FIG. 4, and comprises a plate-form main body portion 33*a* which is connected to the stempins 29. A discharge limiting opening 34 is formed by a protruding part 33*b* which enters the concave portion 16 from the main body portion 33*a*. This protruding part 33*b* is separated from a wall face 16*b* of the concave portion 16 and takes the form of a truncated cone extending along the wall face 16*b* in the tube axis G direction. By forming such a discharge limiting opening 34 within the concave portion 16, the generation region of the arc ball S within the concave portion 16 can be restricted, thereby raising the generation density of the arc ball S in the discharge limiting opening 34 such that luminance is increased.

Figure 5:
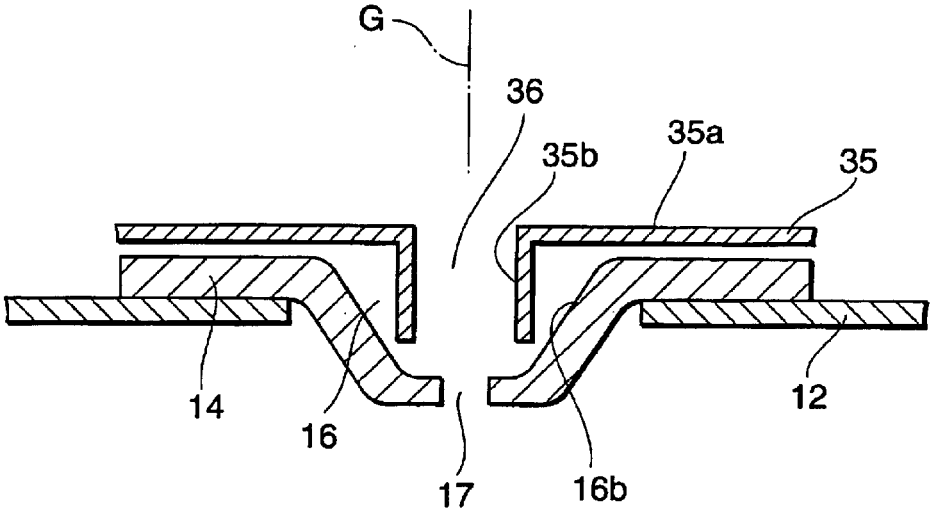
FIG. 5 is a sectional view showing another modified example of a discharge limiting portion which is applied to the gas discharge tube according to the present invention.

As shown in FIG. 5, another discharge limiting plate 35 extends parallel to the conductive plate 12 and comprises a plate-form main body portion 35*a* which is connected to the stempins 29. A discharge limiting opening 36 is formed by a protruding part 35*b* which enters the concave portion 16 from the main body portion 35*a*. This protruding part 35*b* is separated from the wall face 16*b* of the concave portion 16 and takes a cylindrical form extending along the tube axis G. By forming such a discharge limiting opening 36 within the concave portion 16, the generation region of the arc ball S within the concave portion 16 can be restricted, thereby raising the generation density of the arc ball S in the discharge limiting opening 36 such that luminance is increased.

Next, an operation of the above head-on type deuterium discharge tube 1 will be described.

First electric power of approximately 10W is supplied to the cathode portion 20 from an external power source via the stem pins (not shown) for up to twenty seconds prior to discharge in order to preheat the coil portion of the cathode portion 20. Then a voltage of approximately 160V is applied between the cathode portion 20 and anode portion 8, thereby completing the preparation for arc discharge.

Once this preparation is complete, a trigger voltage of approximately 350V is applied from an external power source to the focusing electrode portion 14 via the stem pins 18. Note that since the discharge limiting plate 30 is made of a ceramic, it is continuously maintained in a passive state. Hence discharge is successively generated between the cathode portion 20 and focusing electrode portion 14, and between the cathode portion 20 and anode portion 8. Thus, since the discharge path is ensured by the employment of the discharge limiting opening 31, a starting discharge between the cathode portion 20 and anode portion 8 is reliably generated even when the discharge path is narrowed by the discharge limiting opening 17 having a diameter of 0.2 mm, for example.

When a starting discharge is generated, arc discharge is maintained between the cathode portion 20 and anode portion 8 such that the arc ball S is generated within the concave portion 16. Ultraviolet light emitted from the arc ball S passes through the light exit window 4 as light of extremely high luminance and is discharged outside. At this time, the arc ball S can be continuously maintained in a compressed ball shape even when the lamp is illuminated due to the discharge limiting opening 31, and thus the arc ball S can be shaped with stability, thereby stabilizing the luminance and light quantity.

(Second Embodiment)

Figure 6:
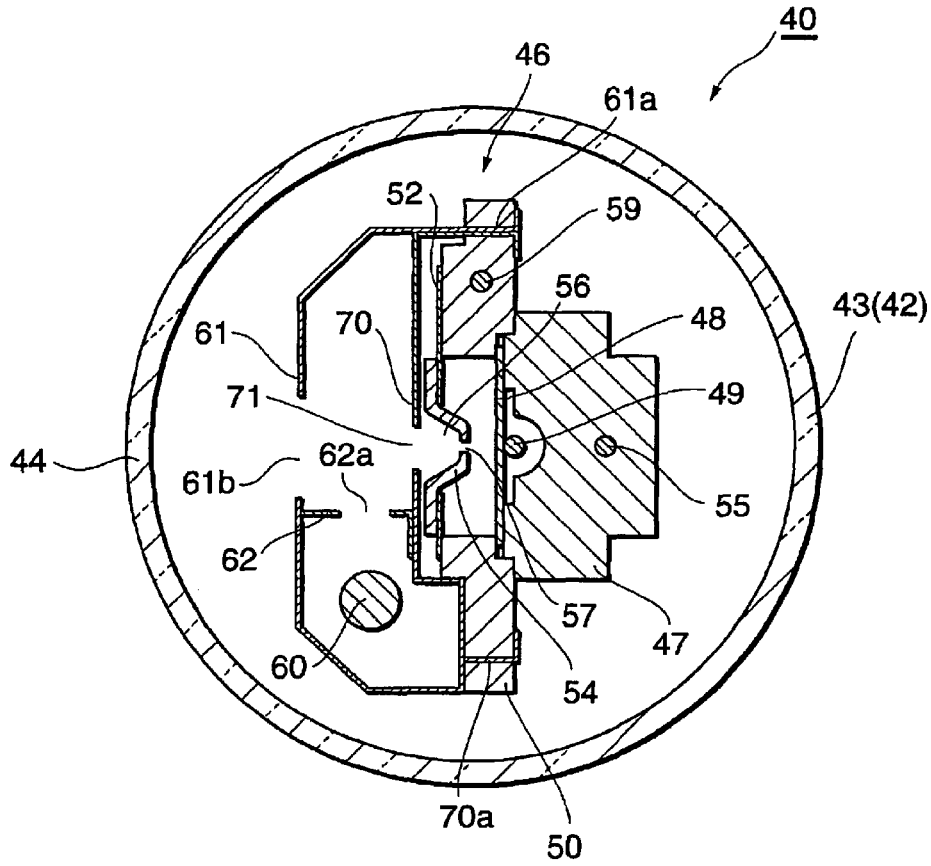
FIG. 6 is a sectional view showing a second embodiment of a gas discharge tube according to the present invention.

As shown in FIG. 6, a gas discharge tube 40 is a side-on type deuterium lamp. This discharge tube 40 is provided with a glass hermetically sealed container 42 into which deuterium gas is sealed at approximately several hundred Pa. The hermetically sealed container 42 is constituted by a cylindrical side tube 43 which seals one end side thereof and a stem (not shown) which seals the other end side of the side tube 43. A part of the side tube 43 is used as a light exit window 44. A light-emitting portion assembly 46 is housed inside the hermetically sealed container 42.

The light-emitting portion assembly 46 comprises a base portion 47 made of an electrically insulating ceramic. An anode plate (anode portion) 48 is disposed in contact with the front face of the base portion 47, and the distal end part of a stem pin 49 disposed in a standing position in the stem so as to extend in the direction of the tube axis G is electrically connected to the back face of the anode plate 48.

The light-emitting portion assembly 46 further comprises a focusing electrode support portion 50 made of an electrically insulating ceramic. This focusing electrode support portion 50 is fixed by being caused to contact the base portion 47 in a perpendicular direction to the tube axis G. The anode portion 48 is fixed by being gripped between the front face of the base portion 47 and the back face of the focusing electrode support portion 50. A conductive plate 52 is disposed in contact with the front face of the focusing electrode support portion 50.

Further, a focusing electrode portion 54 made of metal (for example molybdenum, tungsten, or an alloy thereof) is fixed by welding to the center of the conductive plate 52 in order to narrow the discharge path, and an arc ball shaping concave portion 56 is formed in this focusing electrode portion 54. The concave portion 56 houses an arc ball produced by discharge and is formed in a cup form widening toward the light exit window 44 so that light can be efficiently extracted. A discharge path narrowing opening 57 constituted by a small hole with a 0.2 mm diameter is formed in the bottom face of the concave portion 56 such that a compressed ball shaped arc ball is formed within the concave portion 56, thereby increasing luminance. The conductive plate 52 is electrically connected to the distal end of a stem pin 55 which is disposed in a standing position in the stem, thus enabling electric power to be supplied from outside to the focusing electrode portion 54.

Further, a cathode portion 60 is disposed in the light-emitting portion assembly 46 in a position removed from the optical path on the light exit window 44 side, and this cathode portion 60 is electrically connected to a stem pin 59 disposed in a standing position in the stem via a connecting pin not shown in the drawing. Thermoelectrons are generated by the cathode portion 60, or more specifically, the cathode portion 60 comprises a tungsten coil portion which extends in the tube axis G direction and generates thermoelectrons.

The cathode portion 60 is housed inside a cap-form metallic front cover 61. This front cover 61 is fixed by being bent following the insertion of a claw piece 61*a* provided thereon into a slit hole (not shown) provided in the focusing electrode support portion 50. Further, a rectangular light transmitting port 61*b* is formed in the front cover 61 at the part which opposes the light exit window 44.

A discharge current plate 62 is provided inside the front cover 61 in a position removed from the optical path between the cathode portion 60 and focusing electrode portion 54. An electron-emitting window 62*a* of the discharge current plate 62 is formed as a rectangular opening for allowing the transmission of thermoelectrons. The discharge current plate 62 is fixed to the front face of a discharge limiting plate (discharge limiting portion) 70 to be described hereinafter which is fixed to the focusing electrode support portion 50. Thus the cathode portion 60 is surrounded by the front cover 61 and the discharge current plate 62 such that sputtering material or evaporated material emitted from the cathode portion 60 does not adhere to the light exit window 44.

The light-emitting portion assembly 46 constituted in this manner is provided within the hermetically sealed container 42, and since the interior of the hermetically sealed container 42 must be filled with deuterium gas at several hundred Pa, a glass exhaust pipe (not shown) is formed integrally with the hermetically sealed container 42. This exhaust pipe is sealed by being fused at the end of the assembly process after the air inside the hermetically sealed container 42 has been removed and deuterium gas at a predetermined pressure has been appropriately filled therein.

Here, a discharge limiting plate 70 is separated from the conductive plate 52 in a perpendicular direction to the tube axis G. The discharge limiting plate 70 is fixed by being bent following the insertion of a clawpiece 70*a* thereof into a slit hole (not shown) provided in the focusing electrode support portion 50. The discharge limiting plate 70 is provided with a circular discharge limiting opening 71 formed opposite the concave portion 56. This discharge limiting opening 71 opposes the concave portion 56 in a perpendicular direction to the tube axis G.

Note that the functions of the discharge limiting plate 70 are similar to those of the aforementioned discharge limiting plate 30 in the first embodiment and therefore explanation thereof has been omitted. Since the operational principles of the side-on type deuterium lamp 40 are similar to those of the aforementioned head-on type deuterium lamp 1, explanation thereof has also been omitted.

(Third Embodiment)

Next, another embodiment of the gas discharge tube will be described, but the description thereof will be limited to substantial differences with the first embodiment. Identical or similar constitutional components to the first embodiment have been allocated identical reference symbols and description thereof has been omitted.

Figure 7:
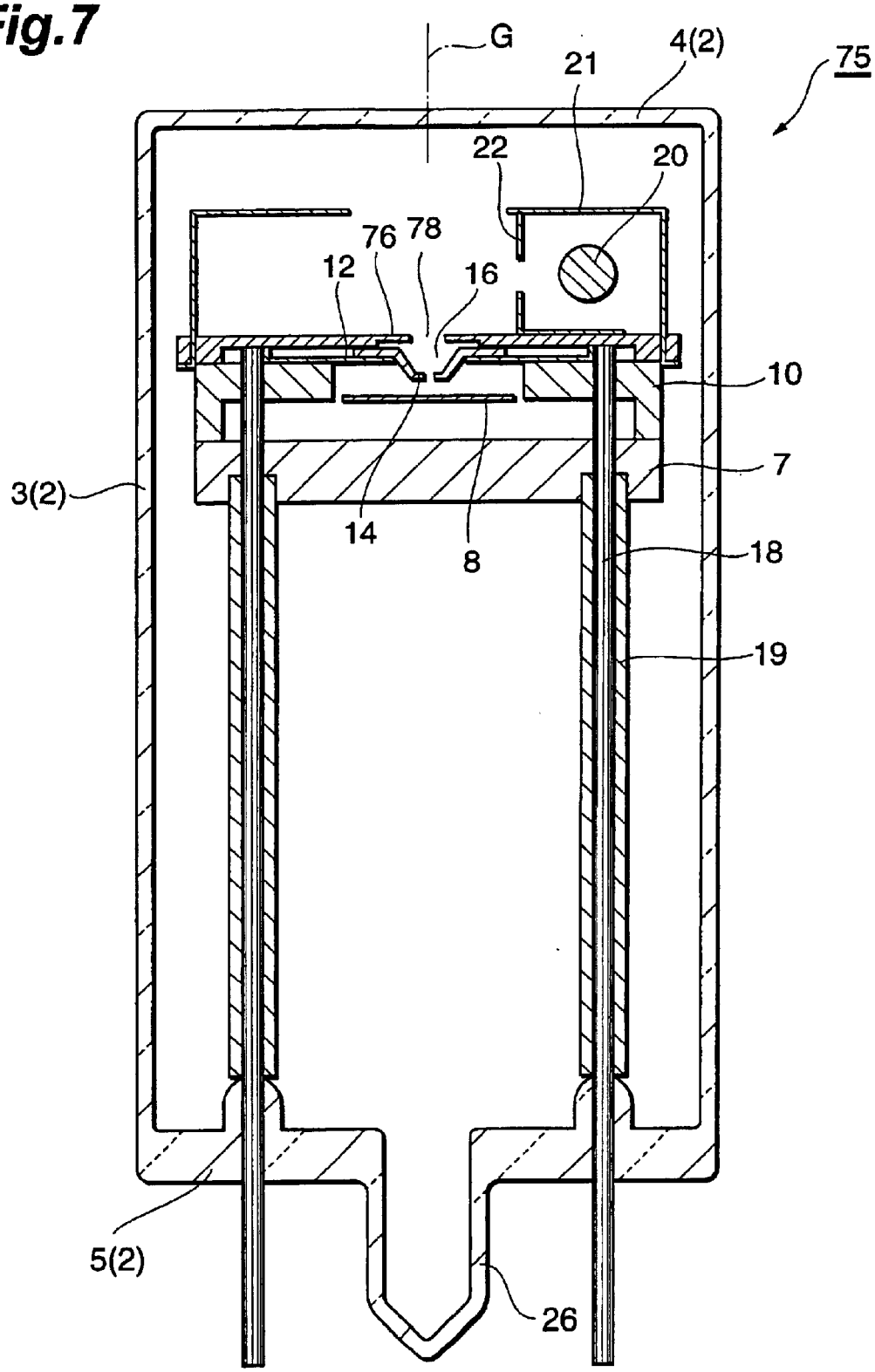
FIG. 7 is a sectional view showing a third embodiment of a gas discharge tube according to the present invention.
Figure 8:
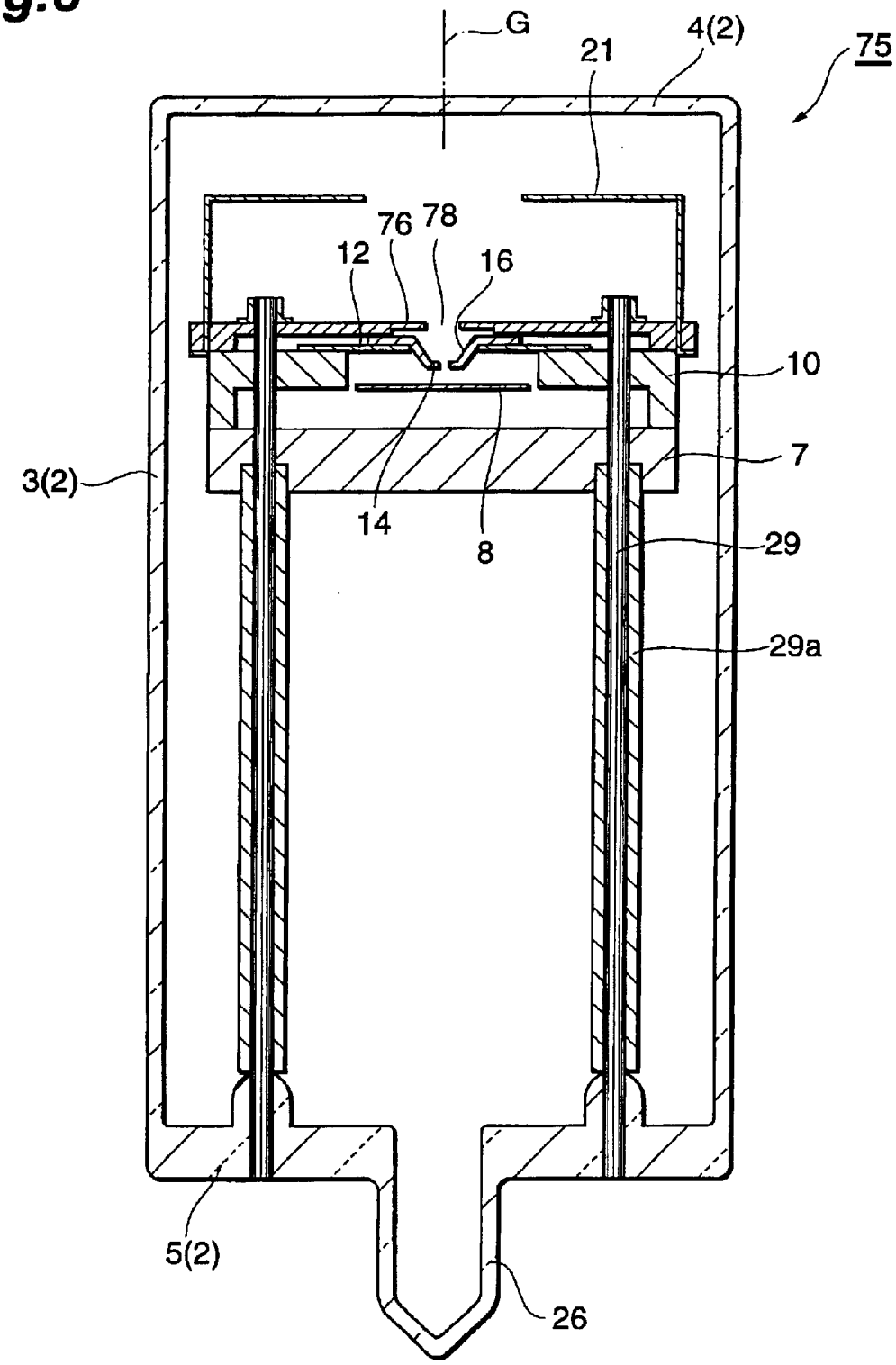
FIG. 8 is a sectional view of the discharge tube shown in FIG. 7.
Figure 9:
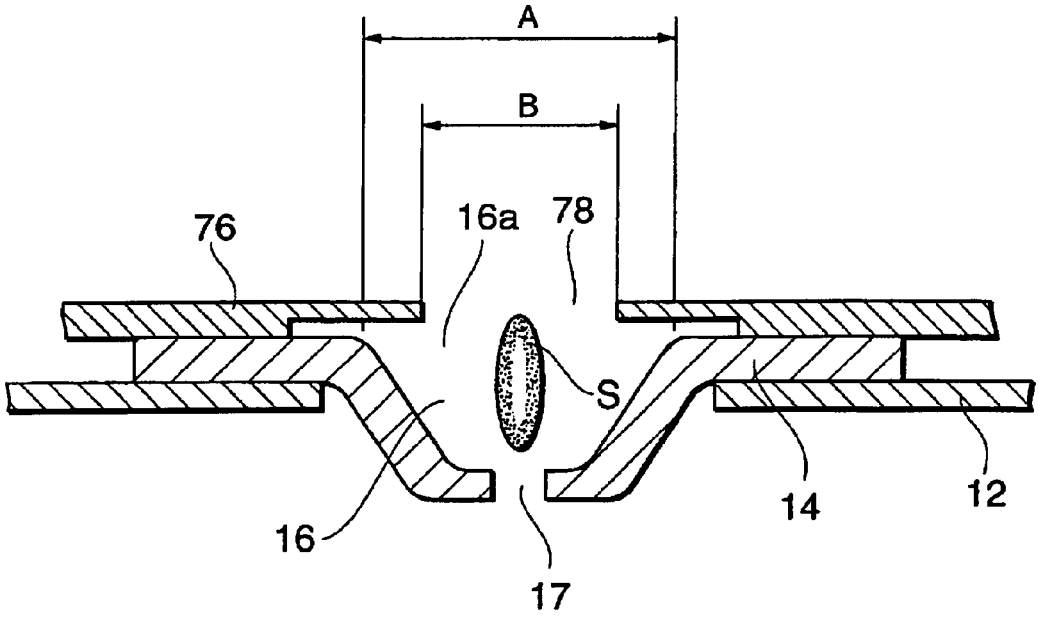
FIG. 9 is an enlarged sectional view of the main parts of the gas discharge tube shown in FIG. 7.

As shown in FIGS. 7 to 9, a head-on type gas discharge tube 75 comprises a discharge limiting plate (discharge limiting portion) 76 made of an electrically insulating ceramic, and this discharge limiting plate 76 contacts the surface of a focusing electrode portion 14 and also contacts a focusing electrode support portion 10. Thus the discharge limiting plate 76 can be seated with stability on the focusing electrode support portion 10. By forming the discharge limiting plate 76 itself from a ceramic, electrical insulation between the focusing electrode portion 14 and discharge limiting plate 76, which are disposed in proximity, can be easily realized. Note that the discharge limiting plate 76 is fixed to the distal ends of stem pins 29 disposed in a standing position in the stem 5 so as to pass through a base portion 7 and the focusing electrode support portion 10. The part of the stem pins 29 which protrudes from the stem 5 has been severed.

The discharge limiting plate 76 is also provided with a circular discharge limiting opening 78 formed opposite a concave portion 16. This discharge limiting opening 78 is formed opposite the concave portion 16 in the tube axis G direction so as to narrow an opening part 16*a* of the concave portion 16 on the light exit window 4 side. If, for example, a diameter A of the opening part 16*a* of the concave portion 16 is 3.2 mm, a diameter B of the discharge limiting opening 31 is preferably 1.5 mm. Hence the shaping space for the arc ball S on the cathode portion 20 side of the concave portion 16 is restricted by the discharge limiting opening 78 disposed in front of the concave portion 16, thus ensuring the formation of a discharge path from the cathode portion 20 to the concave portion 16 with the result that a starting discharge is reliably generated. The discharge limiting opening 78 also allows the arc ball S to be continuously maintained in a compressed ball shape even when the lamp is illuminated, and thus the arc ball S can be shaped with stability, thereby stabilizing the luminance and the light quantity.

(Fourth Embodiment)

Next, another embodiment of the gas discharge tube will be described, but the description thereof will be limited to substantial differences with the second embodiment. Identical or similar constitutional components to the second embodiment have been allocated identical reference symbols and description thereof has been omitted.

Figure 10:
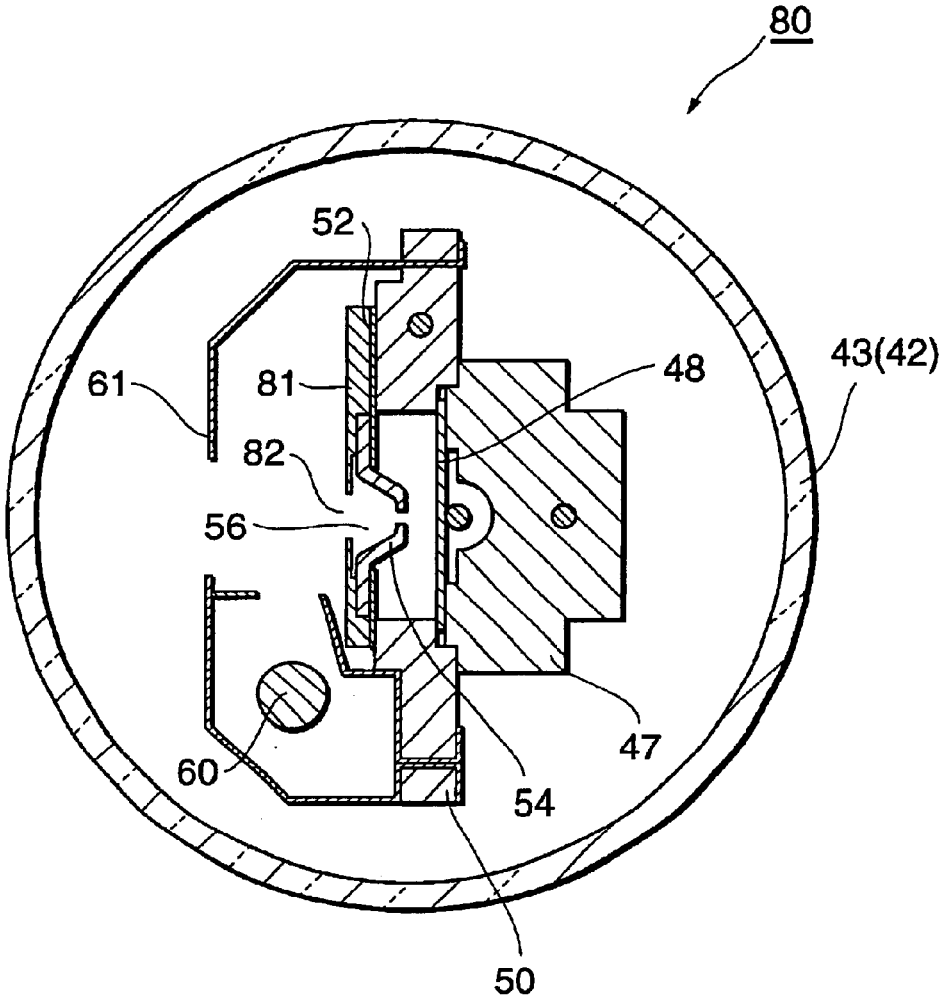
FIG. 10 a sectional view showing a fourth embodiment of a gas discharge tube according to the present invention.

As shown in FIG. 10, a head-on type gas discharge tube 80 comprises a discharge limiting plate (discharge limiting portion) 81 made of an electrically insulating ceramic, and this discharge limiting plate 81 contacts the surface of a focusing electrode portion 54 and also contacts a conductive plate 52. Thus the discharge limiting plate 81 can be seated with stability on a focusing electrode support portion 50. The discharge limiting plate 81 further comprises a circular discharge limiting opening 82 which opposes a concave portion 56 in a perpendicular direction to the tube axis G. Note that the functions of the discharge limiting plate 81 are similar to those of the aforementioned discharge limiting plate 76 of the third embodiment and therefore description thereof has been omitted.

Industrial Applicability

The present invention may be used in a gas discharge tube.

What is claimed is:

1. A gas discharge tube comprising:

a container having a light exit window;

an anode portion disposed within said container;

a cathode portion disposed within said container;

a focusing electrode portion having:

a focusing opening disposed between said anode portion and said cathode portion; and an arc ball shaping concave portion widening toward said light exit window; and a ceramic discharge limiting portion disposed between said focusing electrode portion and said cathode portion, said ceramic discharge limiting portion comprising a discharge limiting opening formed opposite said arc ball shaping concave portion, wherein a diameter B of the discharge limiting opening is smaller than a diameter A of an opening part of said arc ball shaping concave portion, and wherein said ceramic discharge limiting portion contacts a surface of said focusing electrode portion.

2. The gas discharge tube according to claim 1, wherein said discharge limiting opening is disposed opposite said concave portion in order to narrow an opening part of said concave portion on said light exit window side.

3. The gas discharge tube according to claim 1, wherein said discharge limiting opening is formed by a cylindrical protruding part which enters said concave portion from a main body part of said discharge limiting portion.

4. The gas discharge tube according to claim 1, wherein said discharge limiting opening is formed by a truncated cone-form protruding part which enters said concave portion from a main body part of said discharge limiting portion.

5. The gas discharge tube according to claim 1, wherein said ceramic discharge limiting portion is flat.

* * * * *